US006342845B1

(12) United States Patent
Hilliard et al.

(10) Patent No.: US 6,342,845 B1
(45) Date of Patent: Jan. 29, 2002

(54) AUTOMOTIVE VEHICLE CLASSIFICATION AND IDENTIFICATION BY INDUCTIVE SIGNATURE

(75) Inventors: Steven R. Hilliard, Knoxville; Geoffrey W. Hilliard, Signal Mountain, both of TN (US)

(73) Assignee: Inductive Signature Technologies, Knoxville, TN (US)

( * ) Notice: Subject to any disclaimer, the term of this patent is extended or adjusted under 35 U.S.C. 154(b) by 0 days.

(21) Appl. No.: 09/686,920

(22) Filed: Oct. 10, 2000

Related U.S. Application Data

(63) Continuation of application No. 08/982,743, filed on Dec. 2, 1997.
(60) Provisional application No. 60/032,182, filed on Dec. 3, 1996.

(51) Int. Cl.[7] ..... G08G 1/01
(52) U.S. Cl. ..... 340/941; 340/933; 340/934
(58) Field of Search ..... 340/933, 941, 340/934

(56) References Cited

U.S. PATENT DOCUMENTS

| | | | | |
|---|---|---|---|---|
| 1,992,214 A | | 2/1935 | Katz | |
| 3,641,569 A | | 2/1972 | Bushnell et al. | |
| 3,873,964 A | | 3/1975 | Potter | |
| 3,927,389 A | | 12/1975 | Neeloff | |
| 3,984,764 A | | 10/1976 | Koerner | |
| 4,276,539 A | | 6/1981 | Eshraghian et al. | |
| 5,198,811 A | | 3/1993 | Potter et al. | |
| 5,245,334 A | | 9/1993 | Gerbert et al. | |
| 5,491,475 A | | 2/1996 | Rouse et al. | |
| 5,523,753 A | | 6/1996 | Fedde et al. | |
| 5,614,894 A | * | 3/1997 | Stancyzyk | 340/933 |
| 5,861,820 A | | 1/1999 | Kerner et al. | |

* cited by examiner

*Primary Examiner*—Daryl Pope
(74) *Attorney, Agent, or Firm*—Pitts & Brittian, P.C.

(57) ABSTRACT

A system and method for measuring a plurality of successive induction measurements, collectively known as the "inductive signature" of a vehicle, and classifying the vehicle described by the measured inductive signature. The system includes a blade-type wire-loop configuration, or blade sensor and a corresponding measurement circuit employing a discrete measurement technique, as opposed to the frequency counting technique of the prior art. The system and method produce repeatable inductive signatures at a high resolution that allows for accurate identification and classification of a vehicle.

18 Claims, 12 Drawing Sheets

AUTOMOTIVE VEHICLE CLASSIFICATION AND IDENTIFICATION BY INDUCTIVE SIGNATURE

CROSS-REFERENCE TO RELATED APPLICATIONS

This application is a continuation of U.S. application Ser. No. 08/982,743, filed Dec. 2, 1997, which claims the benefit of U.S. Provisional Application No. 60/032,182, filed Dec. 3, 1996.

STATEMENT REGARDING FEDERALLY SPONSORED RESEARCH OR DEVELOPMENT

Not Applicable.

BACKGROUND OF THE INVENTION

1. Field of Invention

This invention relates to a system for measuring changes in an inductive field due to the presence of a vehicle. More specifically, this invention relates to the measurement by inductive sensors of an inductive signature corresponding to a particular vehicle.

2. Description of the Related Art

Metal detectors are widely used to locate metallic objects that are buried or otherwise hidden from view in military, forensic, geological prospecting, archaeological exploration, and recreational treasure-hunting applications. They have many industrial uses including proximity and position sensing and the automated inspection of manufacturing, assembly, and shipping processes. They are the active component in pedestrian screening devices used at airports and other high-security areas to detect the presence of concealed weapons. Inductive vehicle detectors are widely deployed on highways and at intersections for traffic-flow monitoring and control and at parking facilities for revenue and access control.

The measurable inductance of a wire-loop is directly proportional to the magnetic permeability of the space surrounding the loop. Non-metallic matter typically has no measurable effect on the magnetic permeability of the space it occupies, while metallic matter can measurably increase or decrease the magnetic permeability of the space it occupies depending upon its composition. It is well known in the prior-art to measure the inductance of a wire-loop to detect the presence or absence of metal near the loop. The presence of iron tends to increase the inductance of a wire-loop, while the presence of non-ferrous metal tends to decrease the inductance of a wire-loop.

The variation of inductance typically observed by vehicle detectors of the prior art is on the order of five-percent (5%) of the nominal inductance of a conventional wire-loop. Such variation is approximately the same order of magnitude as the electromagnetic noise and thermal drift which affect the wire-loop inductance. Major identifiable sources of electromagnetic noise include electrical power lines, computing and communications equipment, automotive ignition systems, and cross-talk between wire-loops when two or more sensors are deployed in close proximity to one another.

Although variations exist, conventional wire-loops are generally deployed in a rectangular geometry on a plane which is roughly parallel to the surface of the roadway into which they are embedded. For such a conventional wire-loop, the magnetic field generated by the flowing current is described by the Biot-Savart law of physics. The magnetic field forms a generally cylindrical magnetic field around each leg of the wire-loop. The intensity of the magnetic field diminishes linearly as the radial distance from the wire-loop increases. The magnetic fields generated by opposing legs of a wire-loop tend to cancel each other out. By increasing the distance between the opposing legs, a stronger composite magnetic field is created allowing better detection of vehicles. However, the vulnerability of the wire-loop to electromagnetic noise also increases as the separation between the opposing legs of the wire-loop increases. Accordingly, large dimension wire-loops suffer from poor signal-to-noise ratios.

It is well known in the art that the signal strength is strongest when all four legs of a wire-loop inductive sensor simultaneously interact with a vehicle. Increasing the area of the roadway loop so that a vehicle passes only over part of the wire-loop decreases the signal strength and the resulting poor signal-to-noise ratio makes it difficult to reliably detect the presence of differing classes of vehicles. Accordingly, a conventional wire-loop intended for vehicle presence detection is generally centrally positioned within a traffic lane and dimensioned smaller than a typical vehicle such that the variation in the inductance due to a vehicle crossing over the wire-loop is maximized while uncertainties due to electromagnetic noise are minimized. The increased signal strength and improved signal-to-noise ratio obtained using techniques common to conventional wire-loops does not come without cost. A narrowly dimensioned conventional wire-loop is not suitable for providing inductive signature data for vehicle classification and identification as it forfeits the strong signals produced by the wheels. Additionally, the free-running oscillators of the prior art requires the wire-loops in adjacent lanes to be separated by a fair distance to avoid crosstalk. This virtually eliminates the possibility of deploying conventional wire-loops in a manner to present a uniform presence over the entire width of a traffic lane. Because conventional wire-loops do not present a uniform presence, a vehicle may cross at different angles and different lateral offsets. This results in varying inductance measurements for the same vehicle. Therefore, the inductive signature measurements obtained from conventional wire-loops are not repeatable, making accurate classification and identification difficult.

Finally, with regard to the dimensions of conventional wire-loops, it should be noted that their length is limited because a conventional wire-loop is formed within slots cut into the roadway surface. For larger conventional wire-loops, the thermal expansion of the roadway surface tends to destroy those loops which reduces reliability and increases maintenance costs.

Conventional detectors measure inductance by making the wire-loop part of a free running oscillator circuit which has a frequency determined by the inductance of the wire-loop and the capacitance of the circuit. A frequency-counter then counts the number of charge-discharge cycles of the oscillator over a pre-determined period of time. This count is partially a function of the varying inductance of the wire-loop, but also varies with the electromagnetic noise and thermal drift. A temperature change in the wire-loop of only 6-degrees Centigrade would typically cause a baseline drift equal to the full-scale of the inductance variations being measure because the resistance of the wire in the wire-loop is temperature dependent.

Conventional detectors which are able to reliably detect passenger cars are unable to reliably detect vehicles with high ground clearance, such as motorcycles, snow plows, and other large trucks, because of the uncertainty imposed by ambient electromagnetic noise and temperature drift. In addition to reducing traffic flow efficiency, this can lead to property damage and personal injury caused by automated parking gates which prematurely close on vehicles having high ground clearance.

Other devices for measuring changes in an inductive field due to the presence of a vehicle have been disclosed. Typical of the prior art are the following U.S. Patents.

| U.S. Pat. No. | Inventor(s) | Issue Date |
|---|---|---|
| 1,992,214 | D. Katz | 02/26/1935 |
| 3,641,569 | D. Bushnell | 02/08/1972 |
| 3,827,389 | V. Neeloff | 12/16/1975 |
| 3,984,764 | S. Koerner | 10/05/1976 |
| 4,276,539 | K. Eshraghian, et al. | 06/30/1981 |
| 5,198,811 | T. Potter, et al. | 03/30/1993 |
| 5,245,334 | F. Gerbert, et al. | 09/14/1993 |
| 5,481,475 | G. Rouse, et al. | 02/13/1996 |
| 5,523,753 | M. Fedde, et al. | 06/04/1996 |
| 5,614,894 | D. Stanczyk | 03/25/1997 |
| 5,861,820 | B. Kerner, et al. | 01/19/1999 |

U.S. Pat. No. 1,992,214 (the '214 patent) issued to David Katz on Feb. 26, 1935 discloses a traffic detector which operates by detecting changes in a magnetic field induced by the iron in a vehicle. Katz teaches using a coil of wire for measuring disturbances in the earth's magnetic field. With regard to the position and orientation of the coil, Katz teaches a variety of horizontal and vertical arrangements, both above and below ground. To achieve a usable measurement, the dimensions of the coil are selected to produce sufficient separation between the legs of the coil. Katz teaches a separation of approximately three to five feet for vertical coil orientations and five to twelve feet for horizontal coil orientations. The leg separation requirement for vertical coil orientations makes these arrangements impracticable to install, especially in pre-existing roadways, as they require the cutting of at least a three-foot deep slot. Further, Katz teaches encasing the coil in a casing or pipe.

U.S. Pat. No. 3,641,569 (the '569 patent) issued to David Bushnell on Feb. 8, 1972 discloses a highway vehicle sensor system. Bushnell teaches a system including three inductive loops. A first, or main, loop is disposed horizontally within the roadway. Along each of the transverse legs of the main loop, with respect to the roadway axis, a probe loop which is vertically oriented is disposed closely proximate to and coaxial with the transverse leg. The main loop is energized to produce a magnetic field which is sensed by the probe loops. When no vehicles are present, the fields sensed by the probe loops are equivalent. However, when a vehicle crosses one of the transverse legs of the main loop, the field, and therefore the outputs of the probe loops, becomes unbalanced. This imbalance allows the detection of various data such as vehicle presence, direction of travel, vehicle speed, vehicle length, and separation between vehicles.

U.S. Pat. No. 3,827,389 (the '389 patent) issued to Victor Neeloff on Dec. 16, 1975 discloses an apparatus for determining, during operation, the category of a vehicle according to a pre-established group of categories. Specifically, the '338 patent is directed to an arrangement for multiple pressure sensitive cables disposed in a roadway which allows the counting and classification of vehicles based upon wheel base. The cable arrangements taught are selected to reduce the propagation of counting errors in conjunction with the associated wheel height sensor and vehicle separation sensor.

U.S. Pat. No. 3,984,764 (the '764 patent) issued to Steve Koerner on Oct. 5, 1976 discloses an inductive loop structure for detecting the presence of vehicles over a roadway. Koerner teaches a pair of side-by-side loops disposed horizontally within the roadway. The loop pair form a single current path having two terminals which are connected to the detector circuitry. Alternating current is applied to the terminals to produce a commonly oriented magnetic field around the adjacent sides of the loops and an oppositely oriented magnetic field of lesser magnitude around each of the outer sides of the loops.

U.S. Pat. No. 4,276,539 (the '539 patent) issued to Kamran Eshraghian, et al., on Jun. 30, 1981 discloses a vehicle detection system which distinguishes between changes in the measured signal resulting from changes in the environmental conditions and changes caused by an approaching vehicle. The apparatus taught in the '539 patent employs a discrete logic feedback circuit which operates by periodically sampling the measured signal and storing the sample. The sample is then compared to an envelope level equivalent to the amplitude of the previous sample plus a predetermined fixed increment. Should the new sample exceed the envelope level, i.e., the increase per sample time increment exceeds the predetermined maximum rate of change, the "rapid" change in the measured signal is determined to result from the passage of a vehicle as opposed to a "slower" environmental change.

U.S. Pat. No. 5,198,811 (the '811 patent) issued to Thomas Potter, et al., on Mar. 30, 1993 discloses a vehicle communication system using existing roadway loops wherein the physical integrity of the loop is kept intact. Specifically, Potter et al., disclose a vehicle communication system which uses a vehicle mounted transmitting antenna to communicate with a stationary receiver. The stationary receiver is taught to be an existing, conventional roadway loop to receive signals from the vehicle. Potter et al., do not teach anything about the configuration of a conventional wire-loop sensor. Additionally, Potter et al., in the various figures, illustrate a existing roadway loop which is a single loop providing a single current path which is overlapped to form two coils occupying the same general area of the roadway.

U.S. Pat. No. 5,245,334 (the '334 patent) issued to Franz J. Gerbert, et al., on Sep. 14, 1993 discloses a traffic detection cable installation. Specifically, the installation method taught in the '334 patent applies to pressure sensitive cables, e.g., piezoelectric, triboelectric, or stress/strain gauges. The cables are encased in an elastic material in either a side-by-side or an over-under configuration. The elastic material is selected such that mechanical/physical impulses from the weight of the vehicle crossing over the cable enclosure are transmitted to the cables.

U.S. Pat. No. 5,481,475 (the '475 patent) issued to Gordon F. Rouse, et al., on Feb. 13, 1996 discloses a magnetometer vehicle detector. Rouse, et al., teach the use of magneto-resistive sensors having the capability of distinguishing different magnetic signatures of basic vehicle types. The disclosed magnetometers do not constrain vehicles crossing the wire-loop sensors to present repeatable signatures which renders them impractical for precise vehicle classification and identification applications. Additionally, the sensors are sensitive to vehicles in adjacent traffic lanes which introduces an added element of uncertainty to any signature recorded.

U.S. Pat. No. 5,523,753 (the '753 patent) issued to Mickiel P. Fedde, et al., on Jun. 4, 1996 discloses a vehicle detector system with periodic source filtering. Fedde, et al., teach the cancellation of some low-frequency components of the electromagnetic noise which is predictably generated by power-lines and which have a basically periodic nature. Low-frequency noise is amplified, high-frequency noise is unaffected, and only approximately 120 inductance measurements per second may be made using this technique. The time-aperture of the detector is open for an entire 16.7 milliseconds of each sample. The period is undesirable for making precision measurements of rapidly varying inductance. The time-aperture of the detector is time during which a change in the inductance being measured will cause a change in the inductance measurement.

U.S. Pat. No. 5,614,894 (the '894 patent) issued to Daniel Stanczyk on Mar. 25, 1997 discloses a device to detect particularly one or several wheels of a vehicle or of a wheeled mobile engine and the process for using this device. Stanczyk teaches inductive loop detectors disposed horizontally on a roadway. The '894 patent teaches the installation of a number of inductive loops defining a single current path. At least one of the loops has a roadway axis dimension being smaller than the diameter of a vehicle wheel.

U.S. Pat. No. 5,861,820 (the '820 patent) issued to Boris Kerner, et al., on Jan. 19, 1999 discloses a method for the automatic monitoring of traffic including the analysis of back-up dynamics. Kerner, et al., teach the periodic measurement of traffic data, such as vehicle speed and traffic flow, at multiple points within a region of interest along a roadway using inductive loops. By monitoring the relative speeds of the vehicles within the region of interest, areas of traffic congestion are identified.

Accordingly, there is a need for a system and method for the measurement of the inductance corresponding to a vehicle crossing an inductive sensor. There is need for a system that presents a uniform sensor geometry to a vehicle crossing the sensors regardless of the lateral position of the vehicle within the traffic lane. Further, there is a need for a system and method that removes variations due to incident noise and thermal drift from the measured inductance. Finally, a system and method that is capable of sampling changes in the inductive field at a higher sampling frequency than is available with the prior art is needed.

Therefore, it is an object of the present invention to provide an inductive sensor for vehicle detection that constrains a vehicle crossing over the inductive sensor to present a substantially repeatable inductive signature.

It is another object of the present invention to provide an inductive sensor for vehicle detection that substantially overcomes the practical limitations on the length of wire-loops deployed within roadway surfaces.

It is yet another object of the present invention to provide an inductive signature sampling element which is simpler to install and maintain within existing roadway surfaces.

It is a further object of the present invention to maximize the identifying information contained within the inductive signature.

It is a still further object of the present invention to increase the signal-to-noise ratio of the inductive sensor.

It is also an object of the present invention to measure the inductance of an inductive sensor in a relatively short time with relatively high precision by a method that is serially repeatable and substantially independent of preceding and succeeding measurements.

It is another object of the present invention to record an inductive signature of an automotive vehicle by making a plurality of successive measurements of the inductance as a vehicle crosses over an inductive sensor.

It is an additional object of the present invention to use velocity and acceleration profiles of a vehicle crossing over the inductive sensor to compensate, or normalize, for distortions of the inductive signatures recorded for those vehicles.

It is a further additional object of the present invention to classify an unknown vehicle through correlation of the unknown vehicle inductive signature with a known inductive signature.

It is still further additional object of the present invention to classify an unknown vehicle through correlation of a sequence of characteristic point magnitudes from the unknown vehicle inductive signature with sequence of characteristic point magnitudes from a known inductive signature.

It is another object of the present invention to identify whether a newly measured vehicle is a vehicle previously measured through correlation of the unknown vehicle inductive signature with a known inductive signature.

BRIEF SUMMARY OF THE INVENTION

A system and method for measuring a plurality of successive induction measurements, collectively known as the "inductive signature" of a vehicle, and classifying the vehicle described by the measured inductive signature is described. The system includes a blade-type wire-loop configuration, or blade sensor and a corresponding measurement circuit employing a discrete measurement technique, as opposed to the frequency counting technique of the prior art.

The blade sensor is a conductor that is formed around a loop forming member, or form. It is preferred that the blade sensor is installed in a substantially vertical orientation with respect to the roadway surface. A substantially vertical orientation provides the sharpest longitudinal aperture and produces higher quality and more repeatable inductive signatures. Generally, the blade sensor is designed to achieve four goals not simultaneously available with conventional wire loops for measuring inductive signatures. First, the blade sensor is designed to produce repeatable inductive signatures regardless of the lateral position of the vehicle within a traffic lane. Second, the blade sensor is designed to cancel most of the incident electromagnetic differential noise within the blade sensor and to produce a high signal-to-noise ratio. Third, the blade sensor is designed to be easy to install within an existing roadway surface. Finally, the blade sensor is designed to be reliable and generally immune to the effects of thermal expansion of the roadway surface.

In order to achieve repeatability of inductive signatures, the blade sensor is configured to present a uniform loop geometry across the entire width of the portion of the roadway where the measurement of inductive signatures is desired. Accordingly, the form is dimensioned such that the length of the form is sufficient to extend across the entire area of interest, adjusting for the angle of installation. Orienting the blade sensor at an angle with respect to the direction of traffic such that each wheel is detected separately maximizes the information available from the blade sensor. Using such an angular orientation, each wheel produces an identifiable peak in the measured inductance as it crosses the blade sensor thereby improving the quality of the signature. These peaks vary with the differences in the wheels and tires of a vehicle. The character of these peaks is useful for distinguishing between vehicles of the same make and model.

A vehicle crossing the blade sensor has greater influence over the magnetic field generated by the nearer upper leg than over the magnetic field of the lower leg. The difference in magnetic field interaction strength due to the differing vertical depth of each leg from the vehicle results in an improved signal-to-noise ratio when compared to a conventional sensor. It is desirable to maximize the repeatable difference between these two interactions; detectable differences that are not repeatable are considered to be noise and are undesirable.

Both the goals of easy installation and improvement in noise reduction are achieved from shallow depth blade sensors. Although the blade sensor of the present invention accommodates virtually any desired depth, a shallow depth on the order of a few centimeters is convenient to install. The blade sensor of the present invention does not enclose any pavement material. Accordingly, the risk of breakage due to thermal expansion of the pavement is minimized regardless of the dimensions of the blade sensor and reliability is increased while maintenance costs are reduced.

To compensate for noise and thermal drift, one embodiment of the blade sensor includes a secondary loop positioned below the primary loop. The addition of the secondary loop provides for the common-mode rejection of incident noise. To maximize the signal-to-noise ratio, the secondary loop is disposed coplanar with and dimensioned similarly to the primary loop. Because current-carrying wires in close proximity naturally exert significant forces on one another, the primary loop lower leg and the secondary loop upper leg are firmly anchored with respect to one another.

By attaching a capacitor to each of the primary loop and the secondary loop, inductance-capacitance-resistance (LCR) oscillator circuits are formed. These LCR oscillator circuits offer significant improvement over simple inductance-resistance (LR) circuits. Further, closely matching the LCR oscillator circuits such that they have equivalent impedance at the frequency of interest or equivalent LCR values produces the benefits of common-mode rejection, noise cancellation, and thermal-drift compensation. When using the primary wire-loop and the secondary loop, the net magnetic field interaction is substantially that of the primary loop upper leg and the secondary loop lower leg.

The present invention measures the inductance of the wire-loops by a discrete method rather than the frequency-counter method of the prior art. To implement discrete measurement, both LCR circuits are charged for a period of time and then discharged. The output of the LCR circuits is sampled during the discharge cycle. This discrete method of inductance measurement requires only one charge and discharge cycle of the LCR circuits per measurement. Thus, the discrete method provides a result in a relatively short period of time with relatively high precision. The relatively short period of time between the charging of the LCR circuits and the sampling of the output sinusoid defines a favorably narrow time-aperture for the detector. Further, the discrete method is serially repeatable and substantially independent of preceding and subsequent measurements.

The directly observable inductive signature, referred to as the inductive time-signature, represents the inductive profile of the vehicle as a function of time as it crosses the blade sensor. Because the instantaneous velocity of a vehicle crossing the blade sensor can vary over a wide range, the inductive time-signature of a vehicle is generally not as useful for classification or identification of the vehicle as the inductive length-signature. Therefore, it is desirable to transform, or normalize, the inductive time-signature of the vehicle into the more useful inductive length-signature. The inductive length-signature is a normalized set of inductive measurements that can be compared to other inductive length-signatures through statistical methods to classify and identify the vehicle crossing the sensor. Once a correlation is determined to exist between two inductive length-signatures with an acceptable degree of confidence, either the classification or identity of the vehicle is known within a finite degree of confidence. This information is available to be used as intended for a wide variety of applications that include Advanced Transportation Management Systems (ATMS), parking-lot revenue control, car-bomb detection, traffic-law enforcement, and community security among many others.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A system and method for measuring a plurality of successive induction measurements, collectively known as the "inductive signature" of a vehicle, and classifying the vehicle described by the measured inductive signature is described. The system includes a blade-type wire-loop configuration, or blade sensor, illustrated generally at 100 in the figures, and a corresponding measurement circuit, illustrated generally at 800 in the figures. The method for measuring the inductive signature employs a discrete measurement technique, as opposed to the frequency counting technique of the prior art.

Figure 1:
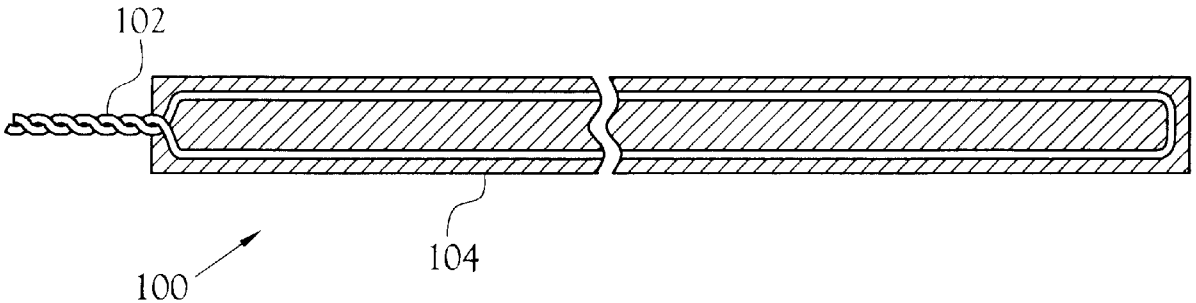
FIG. 1 is a sectional view of a single wire-loop blade sensor of the present invention.

FIG. 1 illustrates a section of the blade sensor 100 of the present invention. The blade sensor 100 is a loop of wire 102 that held in position by a loop forming member, or form 104. It is preferred that the blade sensor 100 is installed in a substantially vertical orientation with respect to the roadway surface. A substantially vertical orientation provides the sharpest longitudinal aperture and produces higher quality and more repeatable inductive signatures. Those skilled in the art will recognize that the orientation of the blade sensor can vary without interfering with the objects and advantages of the present invention. In the preferred embodiment, the form 104 is made of a plastic material that is substantially rigid so as to hold its shape. Those skilled in the art the method of construction of the blade sensor and the configuration of the form can vary without interfering with the objects and advantages of the present invention.

Generally, the blade sensor 100 is designed to achieve four goals not simultaneously available with conventional wire loops for measuring inductive signatures. First, the blade sensor 100 is designed to produce repeatable inductive signatures regardless of the lateral position of the vehicle within a traffic lane. Second, the blade sensor 100 is designed to cancel most of the incident electromagnetic differential noise within the blade sensor 100 and to produce a high signal-to-noise ratio. Third, the blade sensor 100 is designed to be easy to install within an existing roadway surface. Finally, the blade sensor 100 is designed to be reliable and generally immune to the effects of thermal expansion of the roadway surface.

Figure 2:
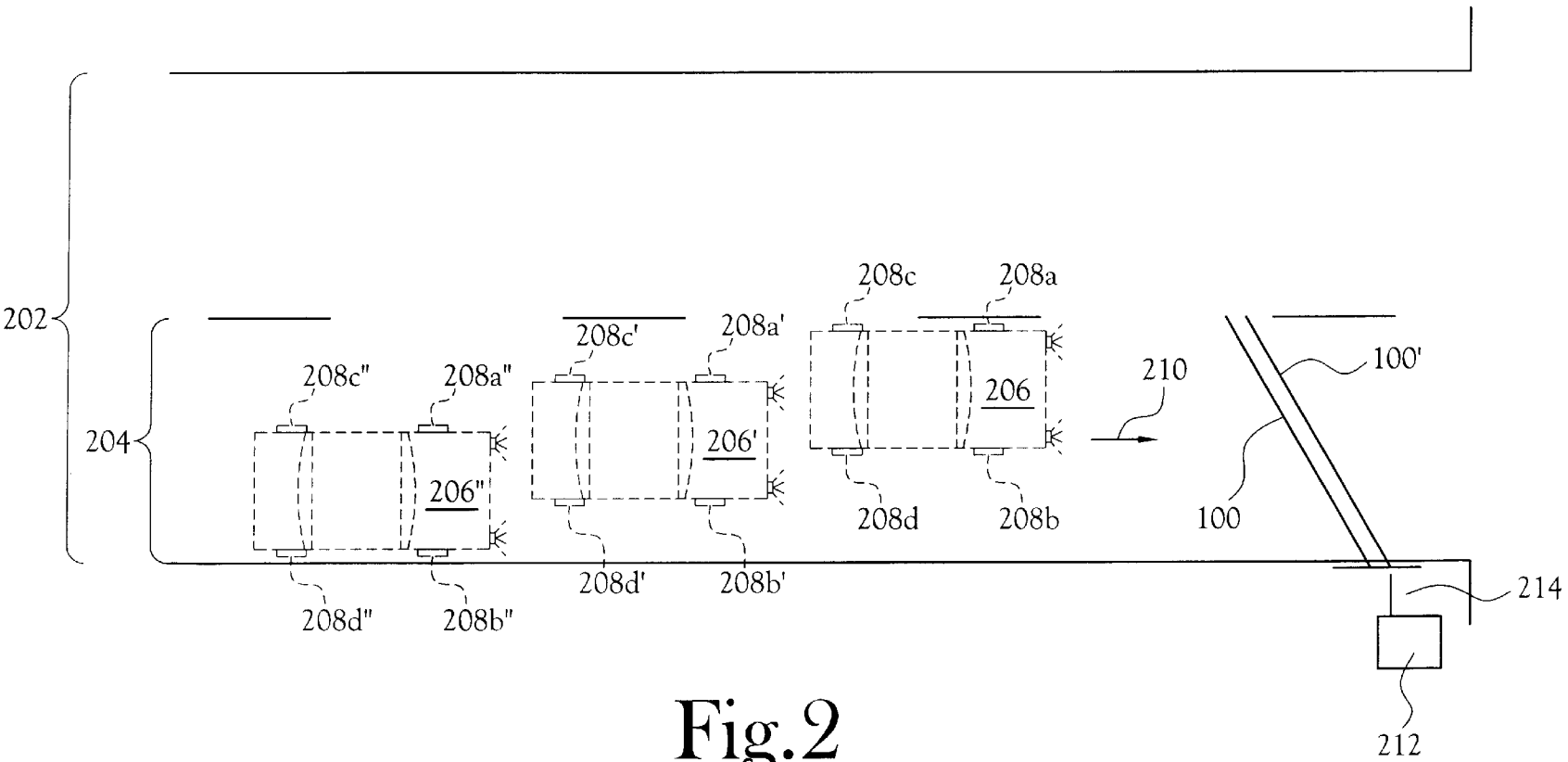
FIG. 2 illustrates the blade sensor of the present invention installed in a typical traffic monitoring situation wherein a uniform geometry is presented throughout the area of interest.

In order to achieve repeatability of inductive signatures, the blade sensor 100 is configured to present a uniform loop geometry across the entire width of the portion of the roadway where the measurement of inductive signatures is desired, as illustrated in FIG. 2. Those skilled in the art will recognize that the portion of the roadway can vary between a single traffic lane 204 and the entire width of the roadway 202 depending upon the object of the inductive signature measurement. Accordingly, the blade sensor 100 is dimensioned such that the length is sufficient to extend across the entire area of interest, adjusting for the angle of installation. In the illustrated embodiment, a pair of blade sensors 100, 100' with a known separation distance are installed at an angle with respect to the flow of traffic 210. The blade sensors 100 are connected to a controller 212 via a set of lead wires 214.

Consider a vehicle 206 traveling in a standard twelve-foot wide traffic lane 204 at three differing lateral offsets within the traffic lane 204: along the left edge of the traffic lane 206, centered within the traffic lane 206', and along the right edge of the traffic lane 206". Assume the width of the vehicle 206 is approximately six feet and that the vehicle 206 is not symmetric. The uniform geometry presented by the blade sensors 100 of the present invention allows consistent inductive signatures to be obtained, regardless of the lateral position of the vehicle 206, 206', 206". Because of the repeatability of the inductive signature, it is possible to classify and identify the vehicle 206. This feature provides the opportunity for Advanced Transportation Management Systems (ATMS) that provide services such as traffic flow monitoring and prediction.

Figure 3:
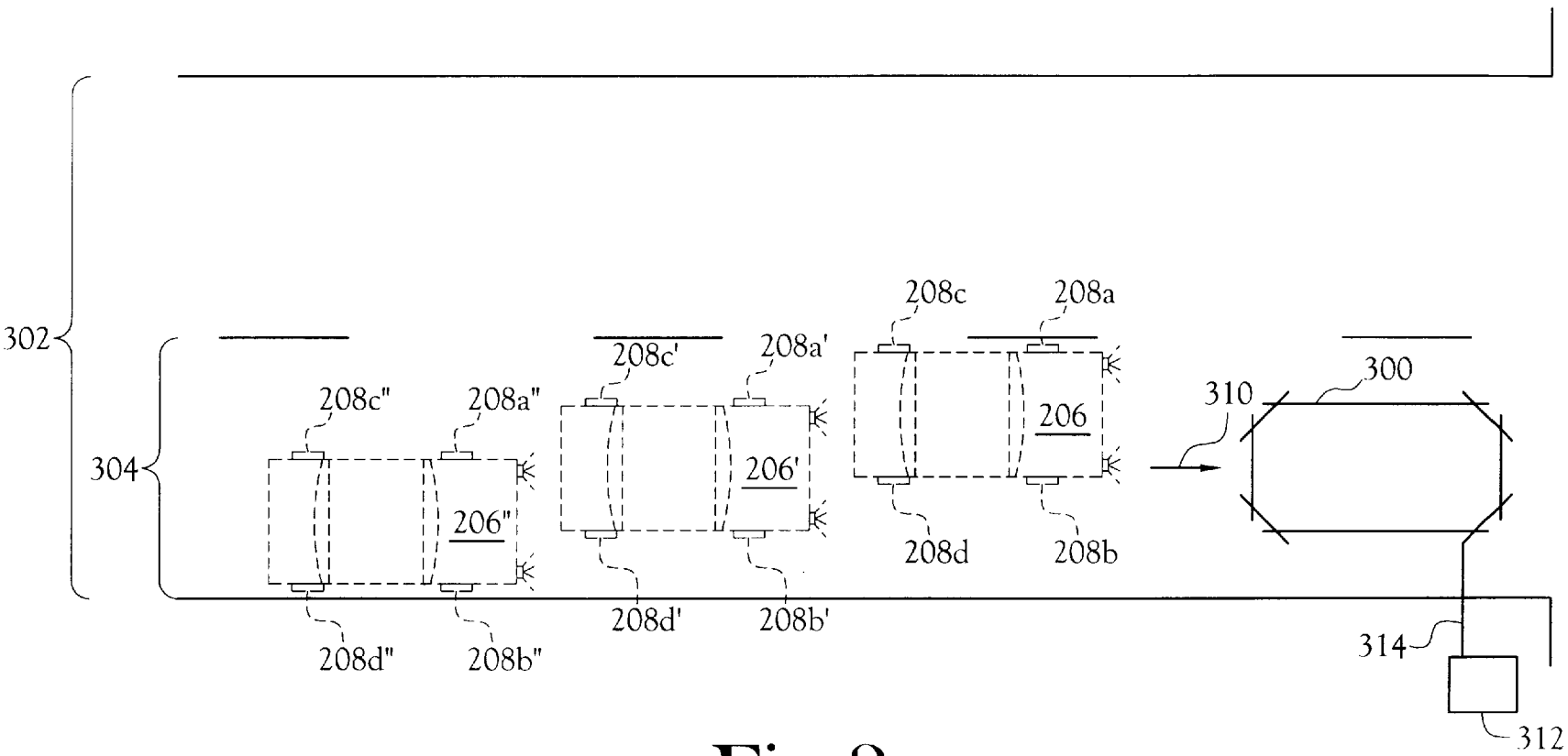
Fig.3 (PRIOR ART)
FIG. 3 illustrates a conventional sensor installed in a typical traffic monitoring situation.

In contrast, a conventional sensor 300 is approximately two meters wide and centered within the lane 304 with the limited intended purpose of detecting the presence of a vehicle 206, as illustrated in FIG. 3. In multilane applications, such spacing provides approximately six feet of separation between convention sensors 300 disposed in adjacent lanes (not shown). As taught by current usage, the four legs of a conventional sensor 300 generally follow the shape of a typical vehicle 206 as oriented in the direction of the flow of traffic 310 along the traffic lane 304 where the conventional sensor 300 is deployed. Although conventional sensors 300 used in multilane roadways 302 can have lead lines 314 which extend across the entire width of a traffic lane 304 to connect the sensor 300 with a controller 312, the field generating legs of a conventional sensor 300 are not known to extend across the entire width of a traffic lane 304 or a roadway 302. Accordingly, conventional sensors 300 do not present a uniform loop geometry to a vehicle 206 traveling at various lateral positions within the traffic lane 304. As a result, the measured inductance of the vehicle crossing a conventional sensor 300 varies with the differing structure of the vehicle 206 that passes over the sensor 300. Specifically, the conventional sensor 300 detects the passenger side of the left edge positioned vehicle 206, the driver side of the right edge positioned vehicle 206", and substantially the entire vehicle of the centrally positioned vehicle 206'. For simple presence detection, it is sufficient to identify the smallest change in inductance that reflects the presence of the vehicle, as signified by either of the left- or right-positioned vehicles 206, 206". However, the measured inductance of the vehicle varies significantly with the lateral offset 206, 206', 206", therefore the inductive signatures measured using a conventional sensor 300 are often not repeatable making classification or identification of a vehicle 206 based upon the inductive signature only 60% to 90% reliable in practice.

Figure 4:
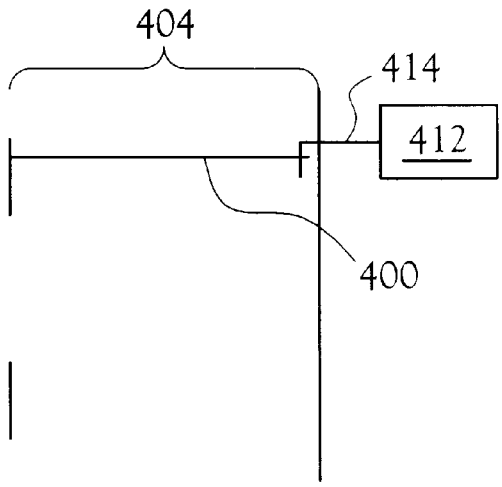
FIG. 4 illustrates the blade sensor of the present invention installed in a first alternate orientation.
Figure 5:
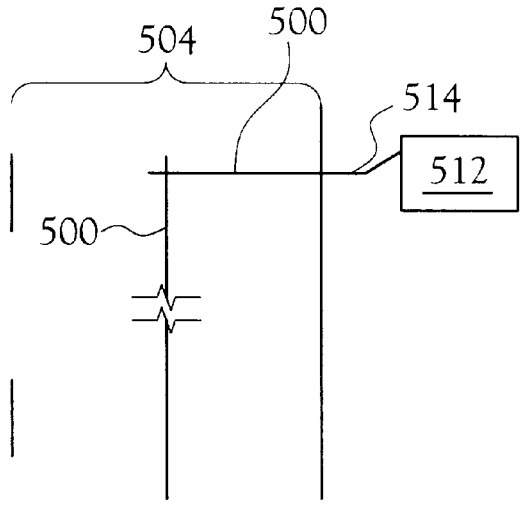
FIG. 5 illustrates the blade sensor of the present invention installed in a second alternate orientation.

Orienting the blade sensor 100 at an angle with respect to the direction of traffic 210 such that each wheel 208 is detected separately maximizes the information available from the blade sensor 100. Using such an angular orientation, each wheel 208 produces an identifiable peak in the measured inductance as it crosses the blade sensor 100 thereby improving the quality of the signature. These peaks vary with the differences in the wheels and tires of a vehicle. The character of these peaks is useful for distinguishing between vehicles of the same make and model. Accordingly, such an angular orientation maximizes the repeatability of the inductive signature produced by a vehicle and facilitates the accurate classification and identification of the vehicle. In the preferred embodiment, a sixty-degree angular offset from the direction of vehicular travel is used; however, those skilled in the art will recognize that significant angular deviations would still provide acceptable results. At one extreme, placing the blade sensor 400 at a ninety-degree angular offset with respect to the traffic lane 404, as illustrated in FIG. 4, obscures some of the available information as both wheels on a particular axis cross the blade sensor simultaneously. In the illustrated embodiment, a lead line 414 connects the blade sensor 400 and a controller 412. At the other extreme, a zero-degree angular offset produces an inductive signature that is virtually useless for classification and identification. However, placing the blade sensor 500 at a zero-degree angular offset with respect to the traffic lane 504, as illustrated in FIG. 5, is useful for estimating the number of vehicles waiting in a lane of traffic at a controlled intersection. In the illustrated embodiment, a lead line 514 connects the blade sensor 500 and a controller 512.

Figure 6:
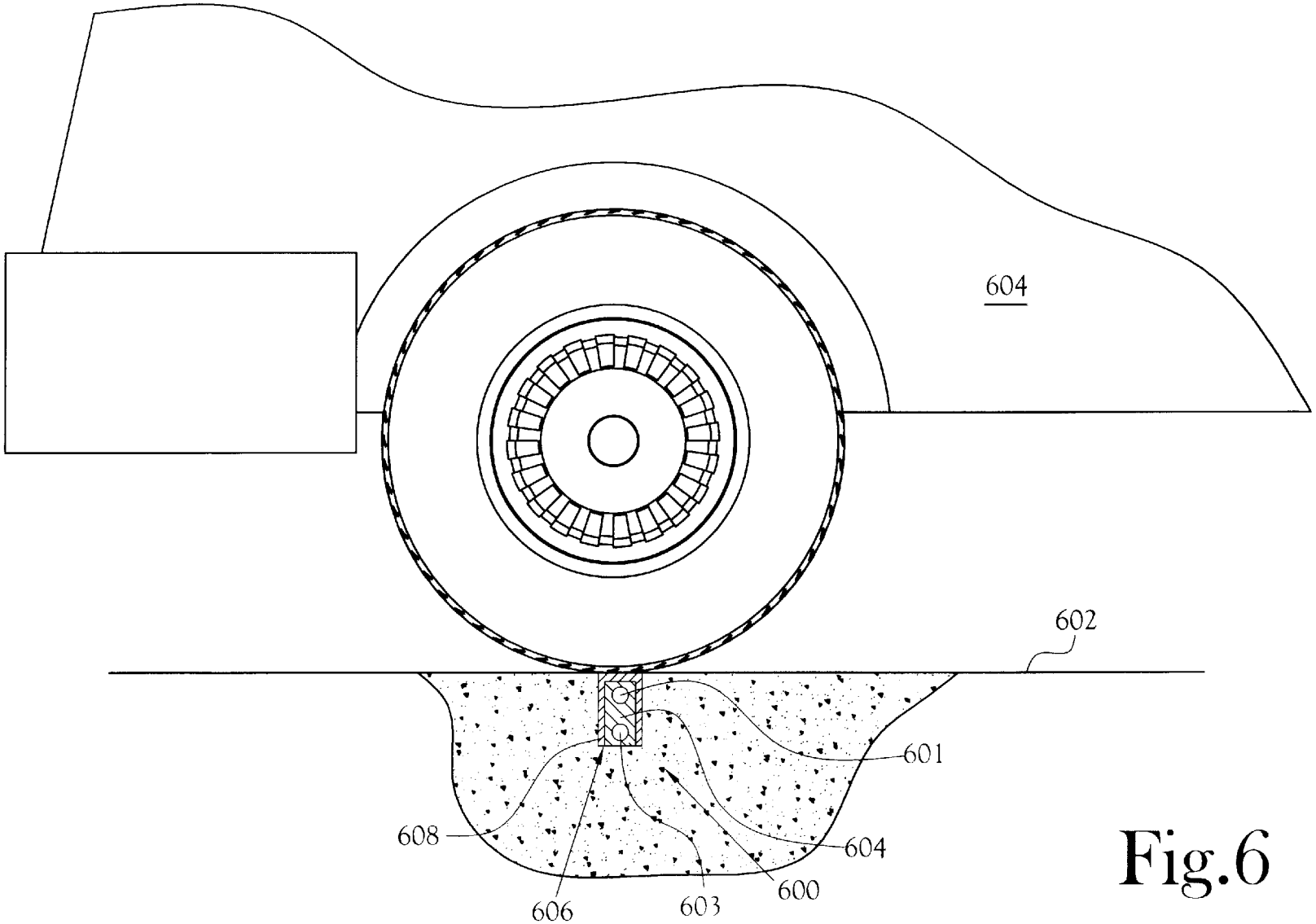
FIG. 6 illustrates a cross section of a roadway wherein a blade sensor according the present invention is installed.

FIG. 6 illustrates the blade sensor of FIG. 1 installed in the preferred substantially vertical orientation with the upper leg 601 being nearer the roadway surface 602 than the lower leg 603. A vehicle 604 crossing the blade sensor 600 has greater influence over the magnetic field generated by the nearer upper leg 601 than over the magnetic field of the lower leg 603. The difference in magnetic field interaction strength due to the differing vertical depth of each leg 601, 603 from the vehicle 604 results in an improved signal-to-noise ratio when compared to a conventional sensor 300. It is desirable to maximize the repeatable difference between these two interactions; detectable differences that are not repeatable are considered to be noise and are undesirable. The measured difference between the magnetic fields represents the change in inductance influenced by the vehicle 604. As previously mentioned, a plurality of these inductance measurements representing the vehicle 604 interacting with the magnetic field of the blade sensor 600 is known as the "inductive signature". The small vertical dimension of the blade sensor 600 contributes to a high signal-to-noise ratio.

Both the goals of easy installation and improvement in noise reduction are achieved from shallow depth blade sensors 100. Although the blade sensor 100 of the present invention accommodates virtually any desired depth, a shallow depth on the order of a few centimeters is convenient to install. The blade sensor 100 of the present invention requires but a single channel to be cut together with any connection routing channels. As with a conventional sensor 300, the channel holding the blade sensor 100 is weather sealed. It is preferred that the form 104 is pre-fabricated; however, it may be fabricated at the point of installation. Further, while it is convenient to configure the form 104 to be substantially rigid and substantially planar in the horizontal dimension, those skilled in the art will recognize that limited flexibility allowing the blade sensor to conform to the horizontal contour of the roadway surface may be desirable in some applications.

By way of comparison, a conventional sensor 300 is also installed by sawing a plurality of channels in the roadway surface, laying the wire-loop in the channels, and sealing the channels. However, referring again to FIG. 3, the installation of a conventional sensor 300 requires that a minimum of four channels, and typically eight, must be cut into the existing roadway surface in addition to channels for routing the connection 314 between the conventional sensor 300 and the controller 312.

As the geometry of a conventional sensor 300 conforms to that of the channels cut into the pavement, a conventional sensor 300 is susceptible to breakage caused by the thermal expansion of the pavement into which it is installed. To mitigate the effects of thermal expansion, the size of the conventional sensor 300 is limited to minimize the amount of enclosed pavement. Because the blade sensor 100 of the present invention does not enclose any pavement material, the risk of breakage due to thermal expansion of the pavement is minimized regardless of the dimensions of the blade sensor 100. Accordingly, the reliability of the blade sensor 100 is improved and maintenance costs are reduced without limitation to the length of the blade sensor 100.

The improvements achieved with the blade sensor 100 of the present invention over a conventional sensor 300 allow greater freedom in designing a traffic monitoring system. By providing a uniform geometry which allows for the measurement of repeatable inductive signatures and a high signal-to-noise ratio, the blade sensor 100 of the present invention is particularly well suited for vehicle identification and classification due to the high resolution of the inductance measurements obtainable with the blade sensor 100.

Figure 7:
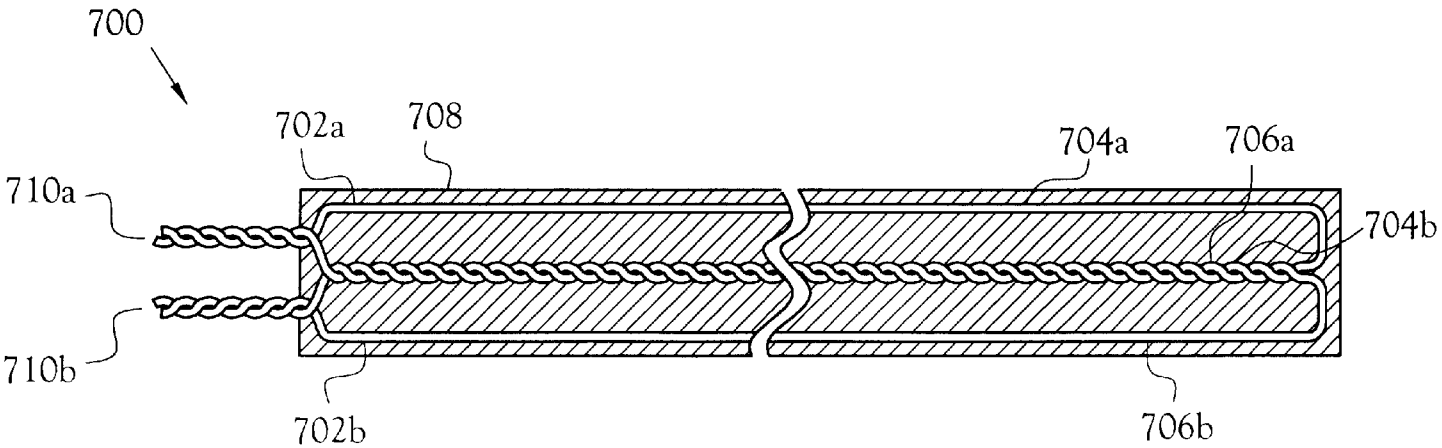
FIG. 7 is sectional view of an alternate embodiment of the blade sensor having two wire-loops deployed in an over-under configuration.

The wire-loop 102 described heretofore and illustrated in FIG. 1 is a simple conductor having both inductance and resistance properties, an inductance-resistance (LR) circuit. These wire-loops 102 act as antennas that naturally receive undesirable electromagnetic noise that introduces a degree of uncertainty into each inductance measurement made. Even a small change in the temperature of the wire-loop 102 causes a significant change in the resistance of the wire-loop 102 that affects the inductance measurements of the blade sensor 100 in the form of thermal drift. It is difficult to distinguish this noise and thermal drift from the inductance changes that are being measured. To compensate for this noise and thermal drift, the alternate embodiment of the blade sensor 700, as illustrated in FIG. 7, includes a secondary loop 802*b* positioned below the primary loop 802*a*. The addition of the secondary loop 802*b* provides for the rejection of incident differential noise.

The blade sensor 700 is generally dimensioned with a shallow depth for differential noise cancellation and easy installation, a width sufficient to accommodate the desired number of turns of wire, and a length that extends across at least an entire traffic lane to present a uniform longitudinal aperture to a vehicle regardless of the lateral position of the vehicle within the traffic lane. By way of example, a blade sensor 700 having a form 708 with a length of three meters, a width of three millimeters, and a depth of eight centimeters around which is wound two matched single-turn coils of number 29 nylon-insulated copper wire disposed in an over-under configuration is recommended as a suitable configuration for monitoring traffic in a single traffic lane at the preferred sixty degree angle with respect to the direction of traffic flow. Those skilled in the art will recognize that the configuration of the blade sensor 700 can vary widely without interfering with the objects and advantages of the present invention.

To maximize the signal-to-noise ratio, the secondary loop 702*b* is disposed coplanar with and dimensioned similarly to the primary loop 702*a*. Because current-carrying wires in close proximity naturally exert significant forces on one another, the primary loop lower leg 706*a* and the secondary loop upper leg 704*b* are firmly anchored with respect to one another. In the illustrated embodiment, the primary loop lower leg 706*a* and the secondary loop upper leg 704*b* are twisted together. To further reduce inductance variations due to temperature differential, it is preferred that the primary loop 702*a* and the secondary loop 702*b* are thermally coupled. This is accomplished in the present invention by using a thermally conductive common loop forming member 708 to form each of the primary loops 702*a* and the secondary loop 702*b*. Finally it should be noted that, in the illustrated embodiment, the upper legs 704 of the primary and secondary loops 702 are twisted together to form a first lead wire pair 710*a*. Similarly, the lower legs 706 of the primary and secondary loops 702 are twisted together to form a first lead wire pair 710*b*. This serves to prevent differential noise from being induced in the lead wires 710*a*, 710*b*.

Figure 8:
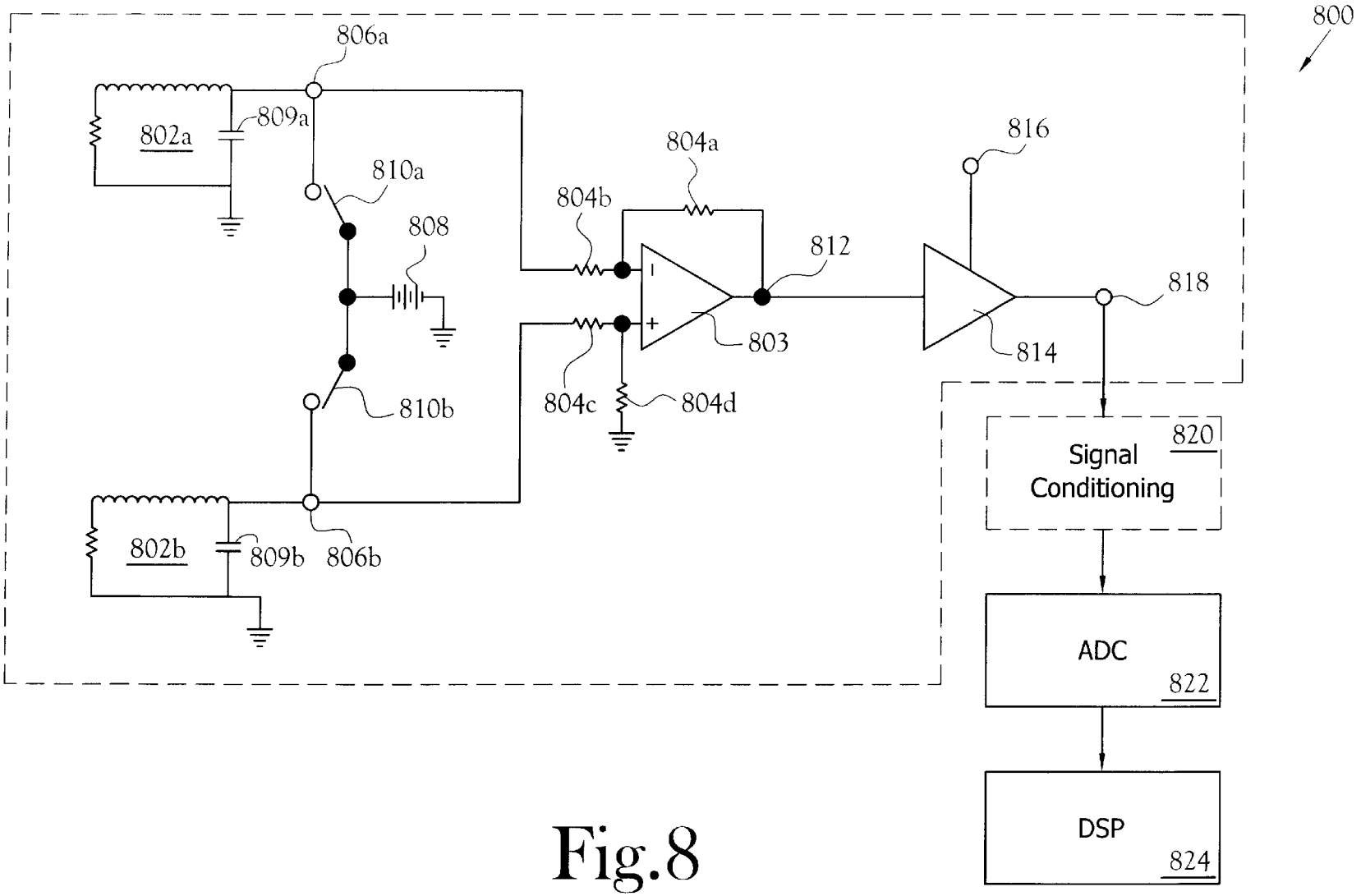
FIG. 8 is a schematic diagram of the measurement circuit of the present invention.

FIG. 8 schematically illustrates one embodiment of a measurement circuit 800 of the present invention. By attaching a capacitor 809 to the circuit 800 coupled with each of the primary loop 702*a* and the secondary loop 702*b*, inductance-capacitance-resistance (LCR) oscillator circuits 802*a*, 802*b* are formed. These LCR oscillator circuits 802 offer significant improvement over simple inductance-resistance (LR) circuits. Further, closely matching the LCR oscillator circuits 802 such that they have equivalent impedance at the frequency of interest or equivalent LCR values produces the benefits of common-mode rejection, noise cancellation, and thermal-drift compensation. When using the dual loop blade sensor 700, the net magnetic field interaction is substantially that of the primary loop upper leg 704*a* and the secondary loop lower leg 706*b*.

In the preferred embodiment, the two LCR circuits 802 are operated in parallel to provide common-mode rejection using an instrumentation amplifier 803, thermal-drift compensation, and an estimated −40 dB noise attenuation at all pertinent frequencies. Each LCR circuit charging terminal 806 is connected to a voltage source 808 via a switch 810 and to an input of the instrumentation amplifier 803 which removes the common-mode voltage and amplifies the resulting output while the LCR circuits oscillate 802. Following removal of the common-mode voltage, a sample-and-hold amplifier 814, triggered by a control signal at a logic input terminal 816, samples the instrumentation amplifier output 812 and provides a stable voltage output 818 for digitizing and processing.

The voltage measurement taken during the oscillation of the LCR circuits 802 is digitized by an analog-to-digital converter (ADC) 822. The digitized voltage measurement is subsequently processed by a processing circuit 824. In the illustrated embodiment, the processing circuit 824 is a digital signal processor (DSP). Those skilled in the art will recognize that signal conditioning 820, such as the use of a band pass filter, can optionally be used to condition the composite output sinusoid prior to sampling to improve the signal-to-noise ratio.

The combination of matched LCR circuits 802 is so effective at noise cancellation that the noise-floor of the best available operational amplifier operating at room temperature, used for the instrumentation amplifier 803, becomes the limiting factor for the signal-to-noise performance of the detector. Accordingly, it is critical to choose a low-noise operational amplifier 803 and the lowest practical value for the configuration resistors 804. Optimal performance is achieved when the configuration resistors 804 are matched to high precision. In the preferred embodiment, Analog Devices part number OP-37 is used. In special applications where ultimate performance is required, the fill signal-to-noise potential of the matched LCR circuits 802 is realized by using a cryogenically cooled instrumentation amplifier designed for low temperature operation. In the preferred embodiment, each switch 810 is a power metal-oxide semiconductor field-effect transistor (MOSFET) with the closed resistance and the gate capacitance carefully matched to the other. Matching is generally accomplished by selecting MOSFET switches that are inherently similar or by adding a small trimming resistance to the circuit.

Figure 9:
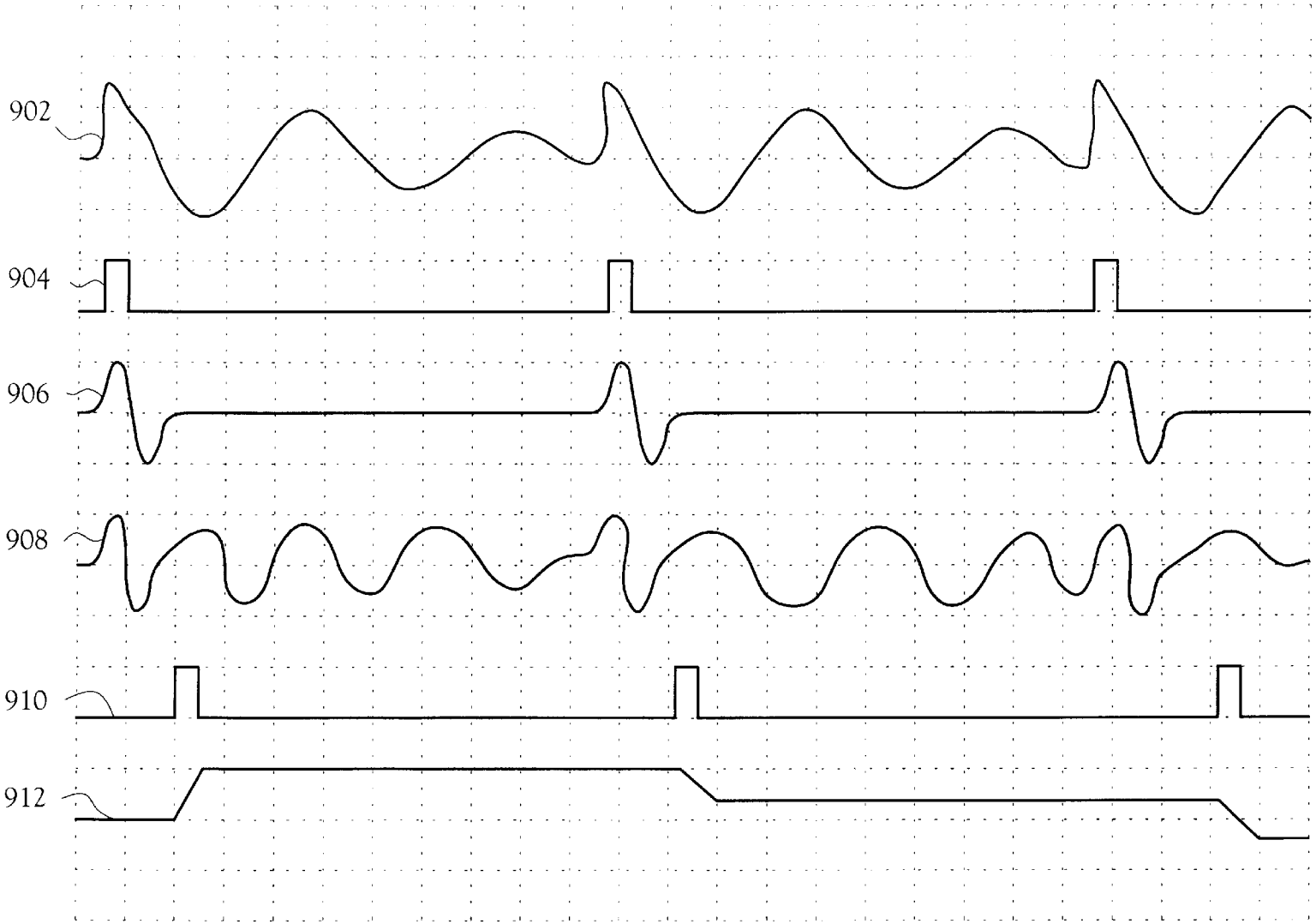
FIG. 9 is a timing diagram of the voltage output at various points of the measurement circuit of FIG. 8.

FIG. 9 is a timing diagram of the voltages measured at various points in the measurement circuit 800. Waveform 902 is a representative charge and discharge sequence for the LCR oscillator circuits 802 observed using an oscilloscope connected to either of the charging terminals 806. Waveform 904 illustrates a typical logic pulse timing for controlling the switches 810 gating the charging current to the LCR circuits. Waveform 906 illustrates the composite output sinusoid at the instrumentation amplifier output 812 when no metal is detected by the LCR oscillator circuits 802. Waveform 908 illustrates the composite output sinusoid at the instrumentation amplifier output 812 when metal is detected by the LCR oscillator circuits 802. Waveform 910 illustrates a typical logic pulse timing applied at the control signal input 816 for triggering the sample-and-hold amplifier 814. Waveform 912 illustrates the voltage at the sample-and-hold amplifier output 818 when metal, which is motion, is being detected.

An ADC 822 is generally characterized by its finite precision. Because the variation of the inductance of the wire-loop is the data of interest and because the maximum variation of this quantity ranges only between approximately 0.2% to 2% of the nominal inductance of the wire-loop, the majority of the useful precision of the ADC 822 is lost to the predictable common-mode voltage when the decaying sinusoidal curve 1002 of each LCR circuit 802 is sampled directly. To avoid this undesirable loss of precision, the preferred embodiment of the present invention subtracts the output of the secondary LCR circuit output 802*b* from the output of the primary LCR circuit 802*a* at the instrumentation amplifier 803. The difference in inductance between the two LCR circuits 802 results in an accumulating phase-shift between the two oscillating sinusoids and a less consequential amplitude-decay differential yielding a composite output sinusoid 906, 908 having an amplitude corresponding to the amplified difference in inductance between the two LCR circuits 802. The resulting composite output sinusoid 906, 908 represents the amplified sum of the instantaneous induced electromagnetic differential noise and the inductance differential between the primary wire-loop 702*a* and the secondary wire-loop 702*b*.

Those skilled in the art will recognize that thermal-drift compensation, a degree of noise cancellation, and common-mode rejection without an instrumentation-type amplifier configuration can be achieved by operating the two LCR circuits in series. For example, at standard power line frequencies approximately −40 dB of noise attenuation is possible using a series LCR configuration. However, the series LCR configuration is not recommended because the noise attenuation is significantly degraded or nonexistent at frequencies above standard power line frequencies.

Figure 10:
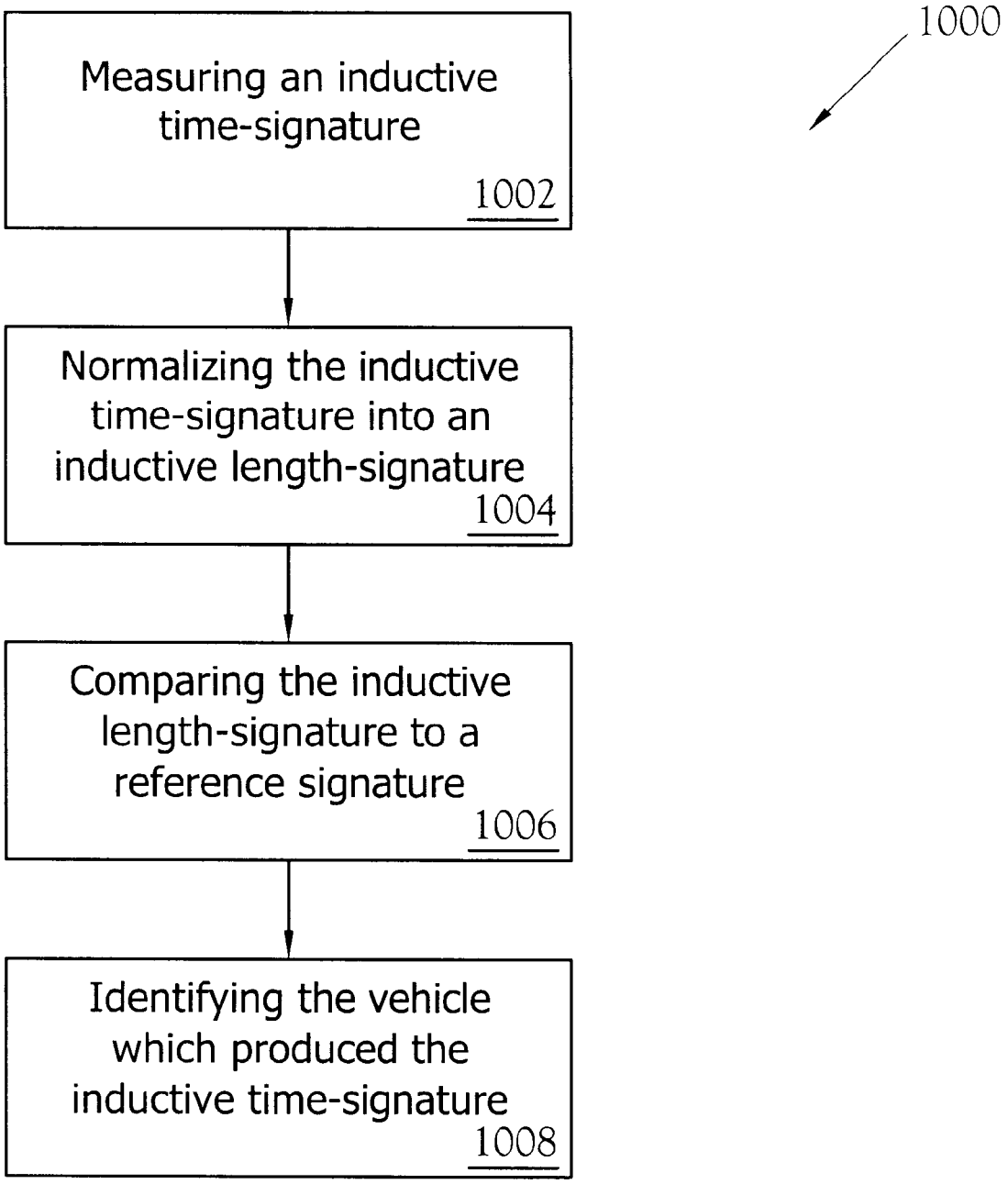
FIG. 10 is a flowchart of one embodiment of a method for classifying and identifying a vehicle based upon an inductive signature measured using the present invention.

FIG. 10 illustrates a flow chart of a method 1000 for identifying or classifying a vehicle based upon an inductive signature of the present invention. The first step of the method is the measurement of at least one inductive signature as a function of time 1002. The present invention measures the inductance of the wire-loops 802 by a discrete method rather than the frequency-counter method of the prior art. To implement discrete measurement, both LCR circuits 802 are charged for a period of time by temporarily closing the switches 810 between each charging terminal 806 and the voltage source 808. This causes the current flowing through each LCR circuit 802 to rise, approaching a limit which is determined by the resistance of the wire-loop, the closed resistance of the switch, and the charging voltage. The voltage of each capacitor 809 approaches a similarly defined limit. After the charging period, the switches 810 are opened thereby initiating independent discharge oscillations of the two LCR circuits 802.

The discrete method of inductance measurement requires only one charge and discharge cycle of the LCR circuits 802 per measurement. Thus, the discrete method provides a result in a relatively short period of time with relatively high precision. The relatively short period of time between the charging of the LCR circuits 802 and the sampling of the output sinusoid defines a favorably narrow time-aperture for the detector. Further, the discrete method is serially repeatable and substantially independent of preceding and subsequent measurements. When coupled with any of the embodiments of the blade sensor 100, 700 of the present invention, the measurement circuit provides for the sampling of the high resolution data at a high frequency providing much more data to the processing circuit than is available with a conventional sensor 300.

In a typical embodiment of the present invention, the sinusoidal output signal of the instrumentation amplifier 803 is sampled only once per cycle. However, in applications where it is desirable to further enhance the signal-to-noise ratio of each individual inductance measurement, additional samples may be taken at any number of points on the output sinusoid within the same induction measurement cycle. The additional samples are combined using any of the digital signal processing techniques known to those skilled in the art to optimize the signal-to-noise ratio. Digital signal processing techniques known to be suitable for optimizing the signal-to-noise ratio of the output include auto-correlation using a Fast-Fourier Transform (FFT) and Finite Impulse Response (FIR) digital filtering. Each of these techniques can be implemented using a suitable microprocessor or digital signal processor and corresponding software or firmware. Those skilled in the art will recognize that these digital signal processing techniques can be applied to a plurality of successive inductance measurements to smooth the inductive signature of the vehicle.

Once an inductive signature has been measured, variations due to the velocity and acceleration of the vehicle are removed from the inductive signature. In step 1004, the inductive signature is normalized with respect to time such that it reflects the effect of the vehicle on the inductive field in relation to its length. The directly observable inductive signature, referred to as the inductive time-signature, represents the inductive profile of the vehicle as a function of time as it crosses the blade sensor 700. Because the instantaneous velocity of a vehicle crossing the blade sensor 700 can vary over a wide range, the inductive time-signature of a vehicle is generally not as useful for classification or identification of the vehicle as the inductive length-signature. Therefore, it is desirable to transform, or normalize, the inductive time-signature of the vehicle into the more useful inductive length-signature. Nevertheless, the amplitude sequence of a set of characteristic points, especially inflection points, of an inductive time-signature can be used for classification or identification of a vehicle without reference being made to the velocity or acceleration profile of the vehicle.

The instantaneous velocity profile and instantaneous acceleration profile of a vehicle are measured by deploying a second blade sensor substantially parallel to and at a known distance from a first blade sensor. A first approximation for the initial phase shift between two inductive signatures assumes that the sampled vehicles are in constant forward motion with a linear acceleration profile during the sampling period. When a vehicle is detected, both blade sensors are triggered simultaneously and the inductance of each blade sensor is sampled at a fixed rate until the vehicle has passed completely over both blade sensors. The resulting inductive time-signature for each blade sensor is stored in a separate data buffer for processing. These inductive time-signatures are substantially similar but phase-shifted.

By dividing the known distance by the initial phase shift of the inductive signatures, the initial velocity of the vehicle is calculated. Changes in the phase shift between the beginning and ending of the inductive signatures and the known distance are used to calculate the instantaneous acceleration profile. Combining the initial velocity with the instantaneous acceleration profile produces the instantaneous velocity profile. Using the instantaneous velocity profile, the measured inductive time-signature is converted into the more useful inductive length-signature. Those skilled in the art will recognize that alternate approaches for deducing the velocity and acceleration profiles of a vehicle from the same available data can be implemented without interfering with the objects and advantages of the present invention.

One method for calculating the inductive length-signatures follows. First, an arbitrary threshold value is applied to the inductive time-signature data and the number of leading and trailing baseline data points from each data buffer are recorded. By relating the difference in the number of leading and trailing baseline data points to the physical separation of the blade sensors and the sampling rate, a direct measurement of the initial velocity and the terminal velocity is obtained. The difference between the values of the initial and terminal velocities is the calculated acceleration of the vehicle during sampling. If a vehicle is accelerating during the sampling period, then distortions in the inductive time-signature are expected. These distortions can cause significant errors when comparing vehicle signatures and must be compensated for during the calculation of the inductive length signature.

In order to produce an accurate comparison, the inductive signatures for comparison must have an equal number of data points in each inductive signature while retaining all pertinent features of the data corresponding to the length of the vehicle. If linear acceleration is assumed, then the mean velocity of the vehicle is used in conjunction with the data points in the inductive time-signature for the vehicle to determine its inductive length. For a linear acceleration profile, one method of producing comparable inductive signatures is achieved by normalizing the data to a fixed number of data points. Acceleration distortions are removed by reorganizing the inductive time-signature into a preselected number of sequential segments of unequal length representing equal length segments of the vehicle. For example, if a vehicle is noted to accelerate by 10% during sampling as it crosses the blade sensors, then the number of data points representing sequential length segments of the vehicle will decrease proportionally in each successive segment with the final segment containing 10% fewer data points than the initial segment. Once the inductive time-signature is divided into segments, each segment is further normalized to a preselected number of data points via standard linear interpolation techniques. The resulting normalized segments are then recombined sequentially to create an inductive length-signature representing the entire length of the vehicle absent the distortion resulting from velocity and acceleration. For example in one embodiment, the data is broken up into 32 sequential segments of unequal length. Each segment is then normalized to 32 data points. When recombined, the resulting inductive length-signature has a fixed length of 1024 data points (32 segments×32 data points per segment). Those skilled in the art will recognize that the number of data points and the number of segments need not be equal and can vary without interfering with the objects and advantages of the present invention.

Other possibilities of compensating for acceleration induced distortions also exist including instantaneous phase-shift analysis accomplished during sampling by altering the detector sampling rate in real-time. The instantaneous phase-shift analysis method is preferred where non-linear acceleration profiles are anticipated.

The normalized inductive length-signature is then compared to a reference signature in step 1006. Those skilled in the art will recognize that the reference signature can vary according to the object of the comparison. Once the distortions due to different velocity and acceleration profiles are removed through the normalization process, independently collected inductive lengths and inductive length-signatures are compared to reference inductive lengths and reference inductive signatures in order to determine if two data sets constitute a match. For example, the reference signature can be a composite signature reflecting a class of vehicles for general classification, a composite signature reflecting the variations between different vehicles of the same model for specific model classification, or a previously measured signature of a particular vehicle for re-identification of the particular vehicle.

Inductive lengths are stored as integer values and are compared directly. However, statistical methods must be used for comparison of the inductive length-signatures. Those skilled in the art will recognize that any number of statistical methods can be used for comparison of the inductive length-signatures without interfering with the objects and advantages of the present invention. One statistical method for comparison is calculating a value for the mean squared error (MSE) between the two normalized inductive length-signatures according to the formula:

$$MSE = \frac{1}{n}\sum_{i=1}^{n}\frac{(x_i - y_i)^2}{x_i}$$

Where n represents the number of data points and x and y represent a sampled value and a reference value.

If the comparison result from step 1006 is within a preselected level of certainty, the vehicle is considered to be accurately identified (or classified) based upon the correlation between the reference signature and measured inductive signature, in step 1008. In the present example, if the mean squared error between the inductive length-signature and the reference signature is less than a preselected value (e.g., 0.05), then they are considered to be a match. Those skilled in the art will recognize that other statistical methods can be employed at this stage of analysis in order to determine if the two signatures are substantially equivalent, such as the Least Squares Analysis of the FFT. In this way sets of data points collected under a variety of conditions are accurately compared to determine a match.

Once a correlation is determined to exist between two inductive length-signatures with an acceptable degree of confidence, either the classification or identity of the vehicle is known within a finite degree of confidence. This information is available to be used as intended for a wide variety of applications that include Advanced Transportation Management Systems (ATMS), parking-lot revenue control, car-bomb detection, traffic-law enforcement, and community security among many others.

FIGS. 11 through 14 represent the best available field data of inductive time signatures obtained at a sample rate of approximately 1500 samples per second using a pair of blade sensors according FIG. 1 of the present invention and the discrete detector circuitry of FIG. 8 adapted for a single blade sensor. As such, the blade sensors and discrete detector circuitry used to the collect the depicted inductive signatures constitute an alternate embodiment of the present invention and not the preferred embodiment.

Figure 11:
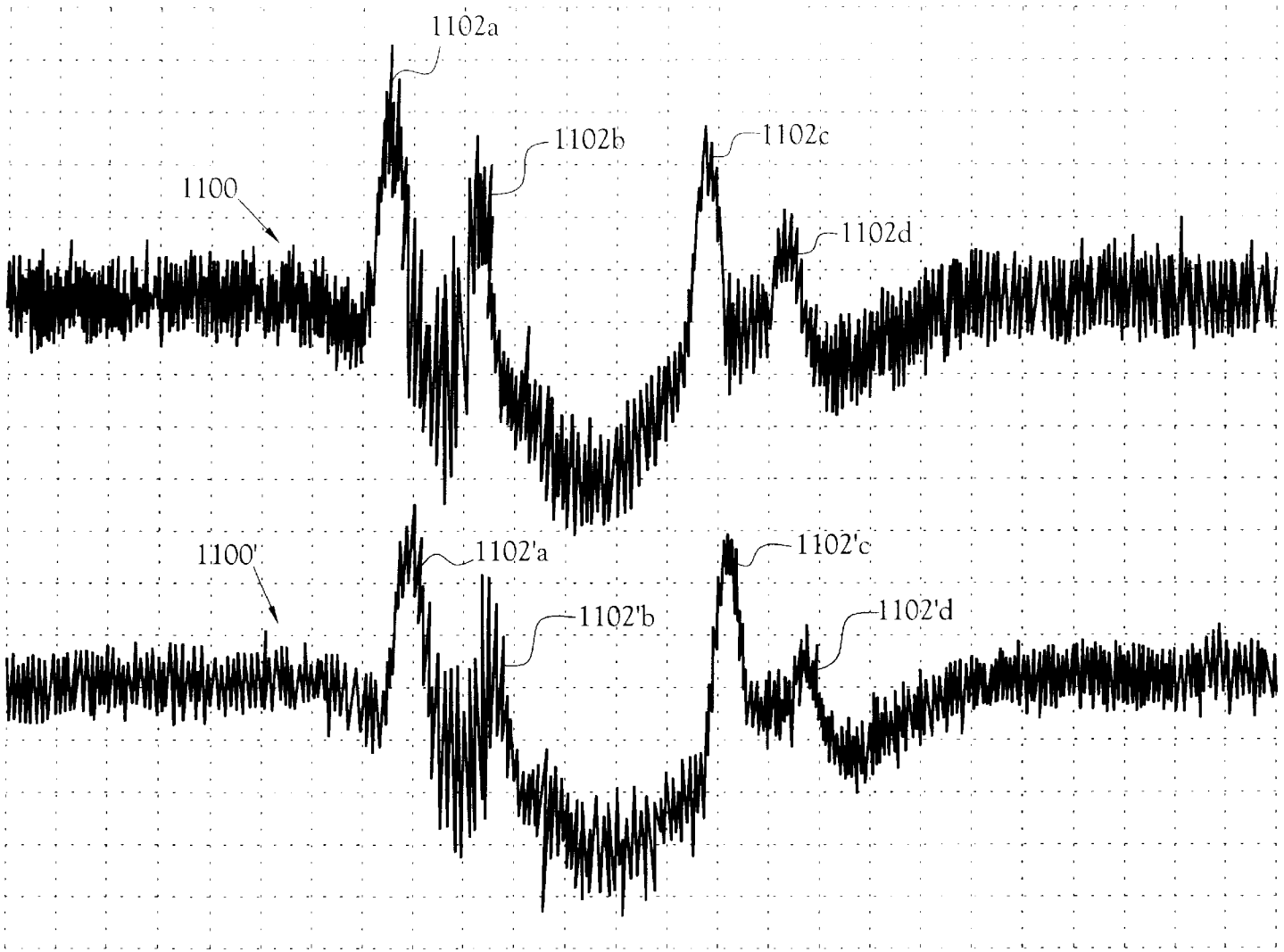
FIG. 11 illustrates an inductive time-signature of a Mercedes 300-CD passenger car using the blade sensor of FIG. 1.

FIG. 11 represents a pair of inductive signatures obtained for a Mercedes 300-CD passenger car. The first inductive signature 1100 was obtained using a first blade sensor 100 and the second inductive signature 1100' was obtained using a second blade sensor 100' positioned approximately twenty centimeters beyond the first blade sensor 100, as illustrated in FIG. 3. The second inductive signature 1100' is a phase-shifted version of the first inductive signature 1100. The phase-shift indicates the instantaneous velocity profile of the vehicle. Some differences in the character of the two signatures 1100 are apparent due to irregularities in the contour of the roadway surface into which the blade sensors 100 were installed.

Figure 12:
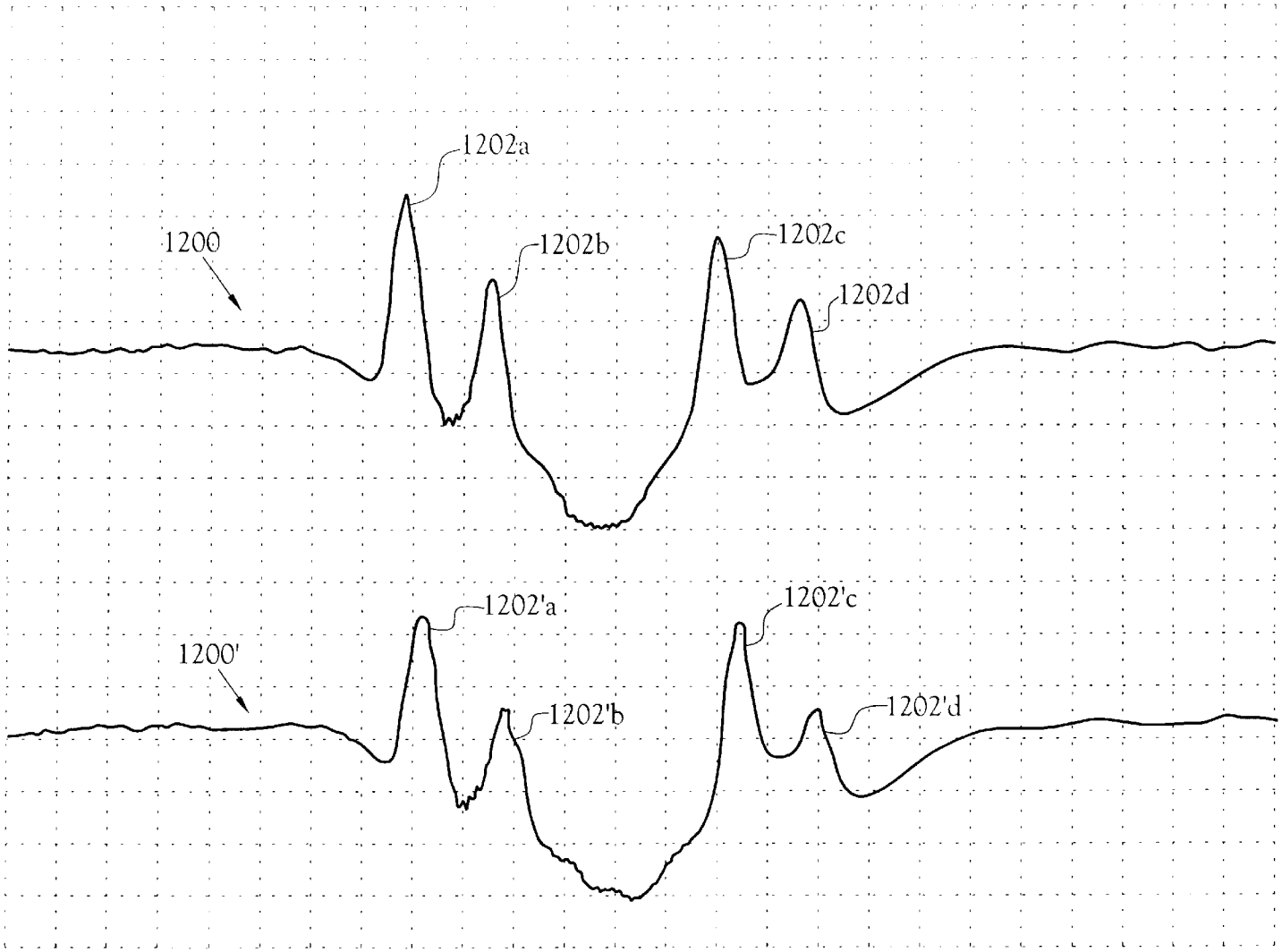
FIG. 12 illustrates the inductive time-signature of FIG. 12 smoothed using a one-hundred point moving average.

FIG. 12 represents smoothed versions 1200 of the respective inductive signatures 1100 of FIG. 11. Smoothing was accomplished using the preferred method of computing a one hundred point moving average of the samples. This preferred method is recommended for real-time data collection, for example detecting and recording inductive signatures, due to the ability to implement this smoothing method in a computationally efficient manner. Once the data has been collected, it is desirable to use more computationally intensive digital filtering for analysis of the inductive signature.

Figure 13:
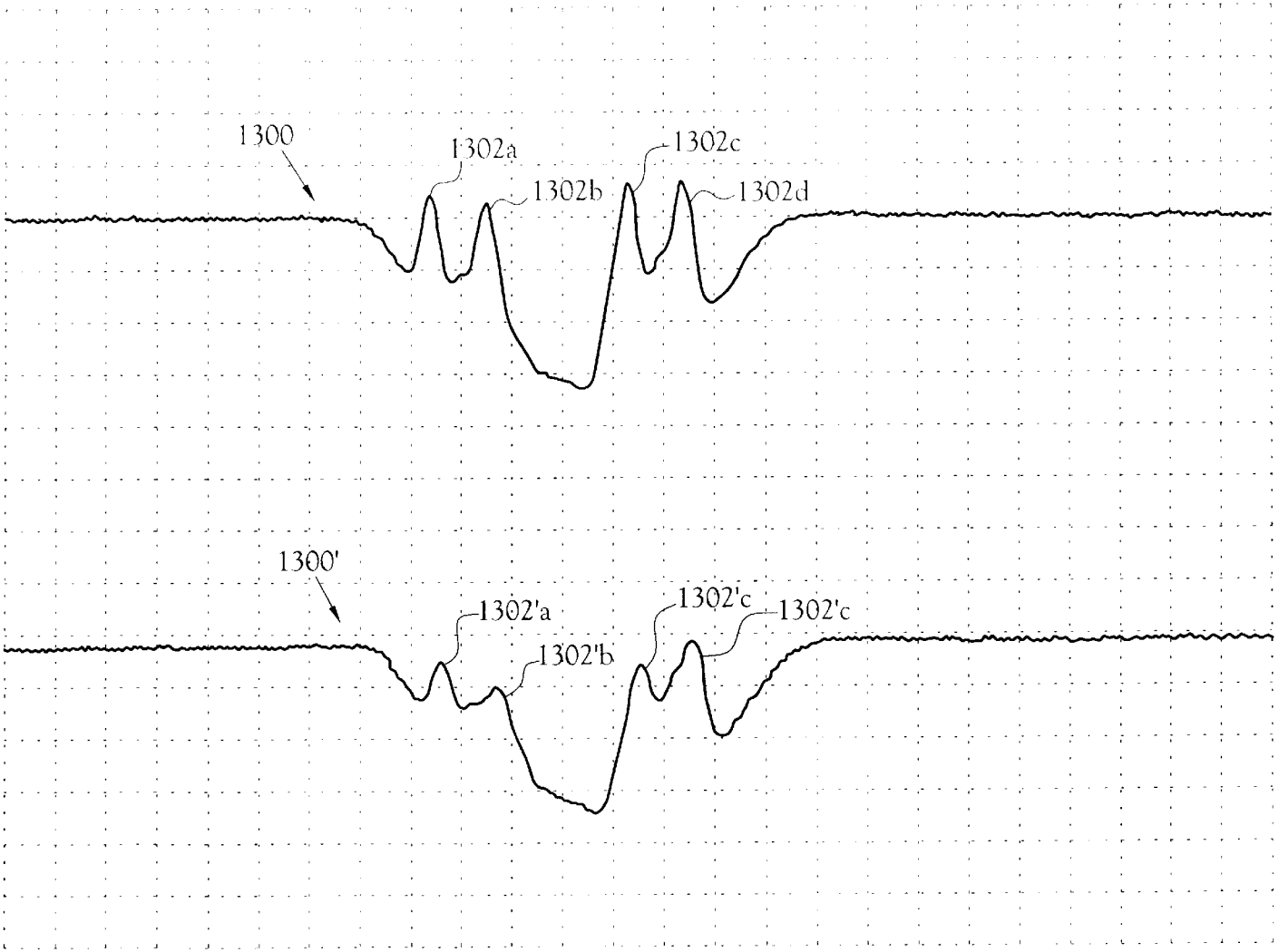
FIG. 13 illustrates an inductive time-signature of a Saab 800 passenger car using the blade sensor of FIG. 1 smoothed using a one-hundred point moving average.

FIG. 13 represents smoothed versions of a pair of inductive signatures for a Saab 800 passenger car obtained using the same pair of blade sensors 100 used to obtain the inductive signatures 1100 of FIG. 11. The first inductive signature 1300 and the second inductive signature 1300' were obtained from the first blade sensor 100 and the second blade sensor 100', respectively. Comparison of these smoothed inductive signatures 1300 with the smoothed inductive signatures 1200 of FIG. 12 demonstrates the variability of the character of the inductive signature between passenger cars.

Figure 14:
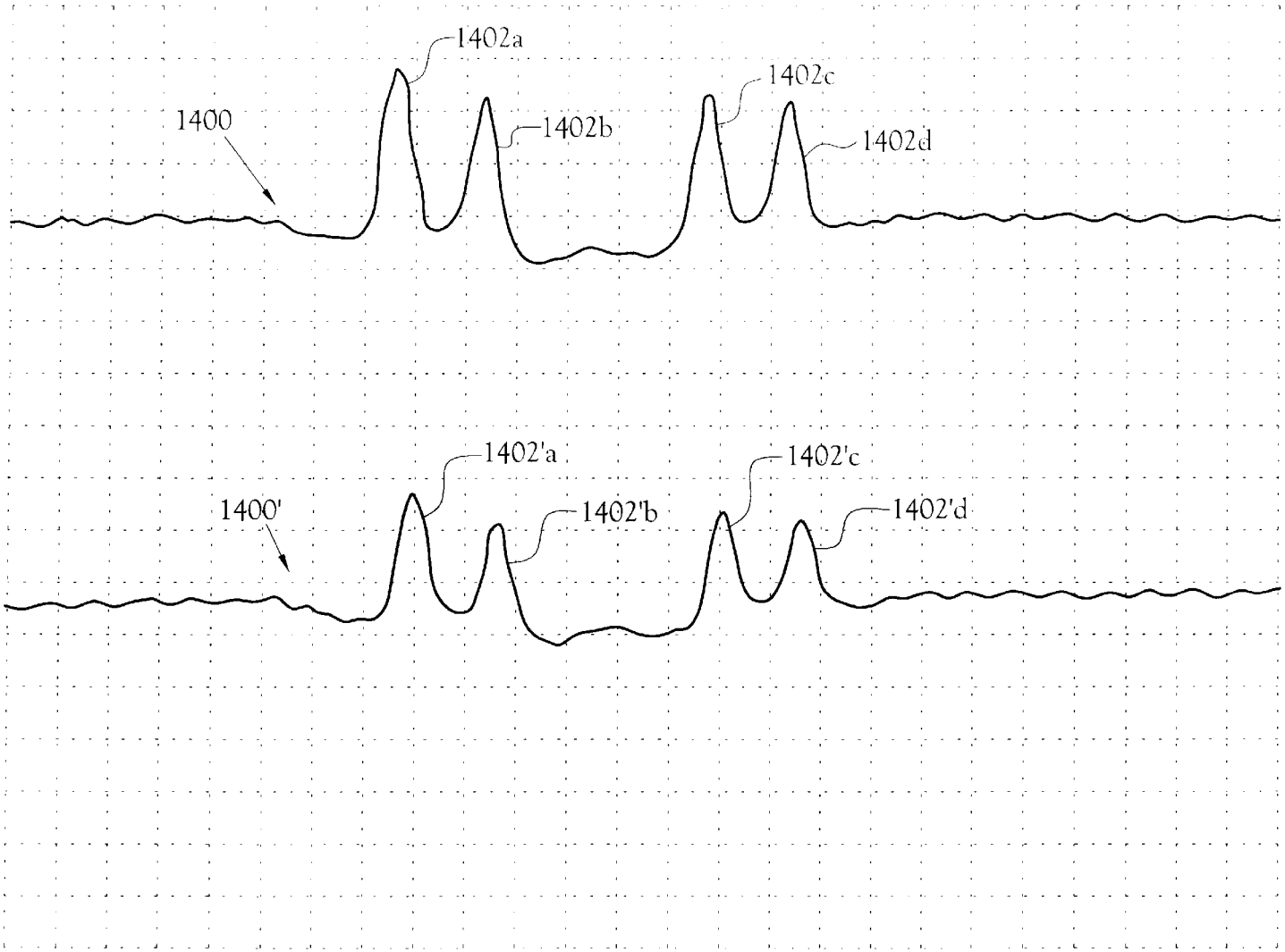
FIG. 14 illustrates an inductive time-signature of a Ford Explorer truck using the blade sensor of FIG. 1 smoothed using a one-hundred point moving average.

FIG. 14 represents smoothed versions of a pair of inductive signatures 1400 for a Ford Explorer truck obtained using the same pair of blade sensors 100 used to obtain the inductive signatures of FIG. 11. Comparison of these smoothed inductive signatures 1400 with the smoothed inductive signatures 1200, 1300 of FIGS. 12 and 13 demonstrates the variability of the character of the inductive signature between passenger cars and trucks.

In each signature 1100, 1200, 1300, 1400, four large peaks 1102, 1202, 1302, 1402 are present. These peaks 1102, 1202, 1302, 1402 are produced by the metal associated with the wheels and steel-belted radial tires crossing the blade sensor 100. From left to right, the peaks represent the driver side front wheel 1102*a*, 1202*a*, 1302*a*, 1402*a*, the passenger side front wheel 1102*b*, 1202*b*, 1302*b*, 1402*b*, the driver side rear wheel 1102*c*, 1202*c*, 1302*c*, 1402*c*, and the passenger side rear wheel 1102*d*, 1202*d*, 1302*d*, 1402*d*. Variations in the wheel-rims and the tire specifications are useful for distinguishing between the inductive signatures produced by vehicles of the same make and model. The ability to distinguish between vehicles of the same make and model is critical to applications such as parking-lot revenue control.

A system and method for identifying and classifying a vehicle based upon an inductive signature has been disclosed having advantages over the prior art. The system includes a blade sensor that presents a uniform geometry, a high signal-to-noise ratio to produce an inductive signature having a high degree of resolution unavailable with conventional sensors. A discrete measurement circuit and method for use allows for a plurality of discrete inductance measurements to be made during a single charge and discharge cycle of the LCR oscillator circuit formed by the blade sensor. When the blade sensor is used in conjunction with the discrete measurement circuit and method described herein, an inductive signature containing more information than is available with the prior art inductive measurement systems is obtained.

The blade sensors of the present invention do not suffer from length limitations imposed on conventional sensors. Accordingly, extended length blade sensors are useful in parking lots to monitor traffic-flow, available spaces, and to perform automated inventory of vehicles resident vs. available spaces on entire rows of cars. Other uses for the system and method of the present invention include Advanced Transportation Management Systems (ATMS), security applications for private communities, car-bomb detection, improved traffic flow monitoring and prediction, traffic law enforcement, and improved parking gate control.

While a number of alternate embodiments have been shown and described, it will be understood that they are not intended to limit the disclosure, but it is intended to cover all modifications and alternate methods falling within the spirit and the scope of the invention as defined in the appended claims.

Having thus described the aforementioned invention, we claim:

1. A blade sensor for detecting a vehicle, said blade sensor comprising:

a loop forming member; and a conductor defining at least one loop carried by said loop forming member, said at least one loop defining at least a first leg substantially parallel to a second leg, each of said first leg and said second leg being substantially parallel to a roadway surface, said first leg being closer to the roadway surface than said second leg, said loop having a horizontal dimension and a vertical dimension, said horizontal dimension being substantially greater than said vertical dimension;

whereby said blade sensor has sufficient resolution to detect a plurality of features of the vehicle.

2. The blade sensor of claim 1 wherein said blade sensor presents a uniform geometry to the vehicle regardless of the vehicle's lateral position with respect to said blade sensor.

3. The blade sensor of claim 1 further comprising a capacitor in electrical communication with said conductor thereby forming an inductance-capacitance-resistance oscillator circuit.

4. A blade sensor for detecting a vehicle on a driving surface, said sensor comprising:

a first conductor defining a primary loop, said primary loop defining at least a first leg substantially parallel to a second leg, each of said primary loop first leg and said primary loop second leg being substantially parallel to the driving surface;

a second conductor defining a secondary loop, said secondary loop defining a first leg substantially parallel to a second leg, each of said secondary loop first leg and said secondary loop second leg being substantially parallel to the driving surface; said secondary loop being substantially coplanar with said primary loop; said primary loop second leg abuts said secondary loop first leg; said primary loop first leg being closer to the driving surface than said secondary loop second leg.

5. The blade sensor of claim 4 wherein said primary loop and said secondary loop are thermally coupled.

6. The blade sensor of claim 4 further comprising a first capacitor in electrical communication with said primary loop thereby forming a first inductance-capacitance-resistance oscillator circuit and a second capacitor in electrical communication with said secondary loop thereby forming a second inductance-capacitance-resistance oscillator circuit.

7. An apparatus for recording an inductive signature of a vehicle on a driving surface, said apparatus comprising:

at least one sensor for detecting variations in an inductive field due to the presence of a vehicle, said at least one sensor disposed substantially perpendicular to the driving surface, said at least one sensor producing a plurality of inductive measurements;

a measurement circuit in electrical communication with said at least one sensor, said measurement circuit producing a output corresponding to said plurality of inductive measurements; and a processing circuit producing an inductive signature by normalizing said output based on a characteristic of said output.

8. The apparatus of claim 7 further comprising an analog-to-digital converter in electrical communication with said measurement circuit for sampling said output.

9. The apparatus of claim 7 wherein said measurement circuit includes a charging circuit in electrical communication with each said at least one sensor.

10. The apparatus of claim 9 wherein said charging circuit comprises:

a voltage source;

a switch coupling said voltage source and one of each said at least one sensor;

a timing signal generator in electrical communication with said switch for opening and closing said switch based on a timing signal.

11. The apparatus of claim 7 wherein each of said measurement circuit includes an operation amplifier in electrical communication with each said first sensor and said second sensor, respectively.

12. The apparatus of claim 11 wherein each said operational amplifier is configured as an instrumentation amplifier.

13. The apparatus of claim 7 wherein said at least one sensor includes a first sensor for detecting variations in an inductive field due to the presence of a vehicle, said first sensor disposed substantially perpendicular to the driving surface, said first sensor producing a first plurality of inductive measurements and a second sensor for detecting variations in an inductive field due to the presence of a vehicle, said second sensor disposed substantially parallel to said first sensor at a known fixed distance from said first sensor, said second sensor disposed in a substantially vertical orientation with respect to the driving surface, said second sensor producing a second plurality of inductive measurements.

14. The apparatus of claim 13 wherein a first measurement circuit is in electrical communication with said first sensor and a second measurement circuit is in electrical communication with said second sensor, said first measurement circuit producing a first output corresponding to said first plurality of inductive measurements; said second measurement circuit producing a second output corresponding to said second plurality of inductive measurements.

15. The apparatus of claim 14 wherein said processing circuit compares said first output to said second output to calculate a time delay between said first output and said second output and normalizes at least one of said first output and said second output with respect to the time delay.

16. A method for measuring an inductive signature of a vehicle, said method comprising the steps of:

(a) charging at least one sensor for a first time period;

(b) discharging said at least one sensor for a second time period;

(c) measuring an output from said at least one sensor at a given frequency as a plurality of discrete measurements during said second time period; and (d) combining said plurality of discrete measurements to form an inductive signature.

17. A method for identifying a vehicle based upon an inductive signature, said method comprising the steps of:

(a) measuring at least one plurality of data points for a vehicle as a function of time;

(b) normalizing one of said at least one plurality of data points with respect to time to produce an inductive length signature;

(c) comparing said inductive length signature to a reference signature; and (d) identifying the vehicle when said inductive length signature and said reference signature correlate to a predetermined level of certainty.

18. The method of claim 17 wherein at least two said plurality of data points are contemporaneously measured using at least two sensors, said step of normalizing one of said plurality of data points further comprising the steps of:

(a) calculating an acceleration profile using a pair of said at least two plurality of data points;

(b) separating said plurality of data points into a number of data segments containing a number of said plurality of data points based upon said acceleration profile;

(c) interpolating each said data segment to produce an equal number of said plurality of data points within each said data segment; and (d) combining each said data segment sequentially to produce an inductive length signature.

* * * * *